US010214793B2

(12) United States Patent
Matsuda et al.

(10) Patent No.: US 10,214,793 B2
(45) Date of Patent: Feb. 26, 2019

(54) METHOD AND DEVICE FOR NITRIDING GRAIN-ORIENTED ELECTRICAL STEEL SHEET

(71) Applicant: JFE STEEL CORPORATION, Chiyoda-ku, Tokyo (JP)

(72) Inventors: Hiroshi Matsuda, Chiba (JP); Hideyuki Takahashi, Fukuyama (JP); Hiroi Yamaguchi, Kurashiki (JP); Yukihiro Shingaki, Kurashiki (JP); Yasuyuki Hayakawa, Asakuchi (JP); Takashi Terashima, Kurashiki (JP)

(73) Assignee: JFE STEEL CORPORATION, Chiyoda-ku, Tokyo (JP)

( * ) Notice: Subject to any disclaimer, the term of this patent is extended or adjusted under 35 U.S.C. 154(b) by 805 days.

(21) Appl. No.: 14/764,650

(22) PCT Filed: Feb. 18, 2014

(86) PCT No.: PCT/JP2014/000818

§ 371 (c)(1),
(2) Date: Jul. 30, 2015

(87) PCT Pub. No.: WO2014/125840

PCT Pub. Date: Aug. 21, 2014

(65) Prior Publication Data

US 2015/0368732 A1 Dec. 24, 2015

(30) Foreign Application Priority Data

Feb. 18, 2013 (JP) ..... 2013-029358
Feb. 18, 2013 (JP) ..... 2013-029380

(51) Int. Cl.
*C23C 8/50* (2006.01)
*C21D 8/12* (2006.01)
(Continued)

(52) U.S. Cl.
CPC ..... *C21D 8/1255* (2013.01); *C21D 6/008* (2013.01); *C21D 8/1272* (2013.01); *C21D 9/46* (2013.01); *C23C 8/50* (2013.01); *H01F 1/16* (2013.01)

(58) Field of Classification Search
CPC ..... C21D 8/1255; C21D 8/1272; C21D 9/46; C21D 6/008; C23C 8/50
See application file for complete search history.

(56) References Cited

U.S. PATENT DOCUMENTS 1,965,559 A 7/1934 Goss
3,087,505 A 4/1963 Laine
(Continued)

FOREIGN PATENT DOCUMENTS

EP 0743370 A2 11/1996
EP 2940160 A1 11/2015
(Continued)

OTHER PUBLICATIONS

English Abstract and English Machine Translation of Huppi (JP 09-118964) (May 6, 1997).*
(Continued)

*Primary Examiner* — Jessee R Roe
(74) *Attorney, Agent, or Firm* — Kenja IP Law PC

(57) ABSTRACT

Provided is a method for nitriding a grain-oriented electrical steel sheet which is very useful in obtaining excellent magnetic properties with no variation by immersing a strip in a molten salt bath after cold rolling and before secondary recrystallization annealing during a production process of a grain-oriented electrical steel sheet, to subject the strip to continuous nitriding to uniformly disperse inhibitor forming elements over the full length and full width of the strip.

7 Claims, 6 Drawing Sheets

(51) Int. Cl.

| | |
|---|---|
| ***H01F 1/16*** | (2006.01) |
| ***C21D 6/00*** | (2006.01) |
| ***C21D 9/46*** | (2006.01) |

(56) References Cited

U.S. PATENT DOCUMENTS

| | | | | |
|---|---|---|---|---|
| 3,174,491 | A * | 3/1965 | Faler | C23G 1/28 134/102.1 |
| 3,932,234 | A | 1/1976 | Imanaka et al. | |
| 4,160,677 | A | 7/1979 | Lukac et al. | |
| 5,512,321 | A | 4/1996 | Paramonov et al. | |
| 5,643,370 | A | 7/1997 | Huppi | |
| 5,779,819 | A | 7/1998 | Huppi | |
| 5,804,053 | A * | 9/1998 | Vaccaro | C25D 5/54 204/206 |
| 7,217,327 | B2 | 5/2007 | Eiraku et al. | |
| 2004/0099342 | A1 | 5/2004 | Cicale et al. | |

FOREIGN PATENT DOCUMENTS

| | | | |
|---|---|---|---|
| JP | S40-15644 | B | 7/1962 |
| JP | S51-13469 | B2 | 4/1976 |
| JP | H03-122227 | A | 5/1991 |
| JP | H03-277726 | A | 12/1991 |
| JP | H09-118964 | A | 5/1997 |
| JP | 2771634 | B2 | 7/1998 |
| JP | 2004-232005 | A | 8/2004 |
| JP | 2005-314775 | A | 11/2005 |
| JP | 3940205 | B2 | 7/2007 |
| JP | 2009-052104 | A | 3/2009 |
| JP | 4321120 | B2 | 8/2009 |
| RU | 2082819 | C1 | 6/1997 |
| RU | 2285731 | C2 | 10/2006 |

OTHER PUBLICATIONS

Jan. 19, 2016, Office Action issued by the Korean Intellectual Property Office in the corresponding Korean Patent Application No. 2015-7024706 with English language statement of relevance.

Feb. 17, 2016, Extended European Search Report issued by the European Patent Office in the corresponding European Patent Application No. 14750977.2.

Dec. 23, 2016, Office Action issued by the Federal Service for Intellectual Property, Patents and Trademarks of the Russian Federation in the corresponding Russian Patent Application No. 2015139583.

May 20, 2014 International Search Report issued in International Patent Application No. PCT/JP2014/000818.

The Surface Finishing Society of Japan, Hyomen Gijutsu Binran, 1st edition, 1st print, The Nikkan Kyogo Shinbun, Ltd., Feb. 27, 1998, p. 890 to 891.

Sep. 1, 2015, Office Action issued by the Japan Patent Office in the corresponding Japanese Patent Application No. 2013-029358.

Sep. 1, 2015, Office Action issued by the Japan Patent Office in the corresponding Japanese Patent Application No. 2013-029380.

* cited by examiner

METHOD AND DEVICE FOR NITRIDING GRAIN-ORIENTED ELECTRICAL STEEL SHEET

TECHNICAL FIELD

The disclosure relates to a method and a device that are suitable for nitriding a grain-oriented electrical steel sheet.

BACKGROUND

A grain oriented electrical steel sheet is a soft magnetic material used as an iron core material of transformers and generators, and is required to have excellent magnetic properties, in particular low iron loss. This steel sheet has a texture in which the <001> direction, which is an easy magnetization axis of iron, is highly accorded with the rolling direction of the steel sheet. Such texture is formed through the so-called secondary recrystallization where crystal grains with (110)[001] orientation referred to as Goss orientation are preferentially grown massively, during secondary recrystallization annealing in the production process of the grain-oriented electrical steel sheet.

Conventionally, such grain-oriented electrical steel sheets have been manufactured by heating a slab containing 4.5 mass % or less of Si and inhibitor components such as MnS, MnSe and AlN to 1300° C. or higher, thereby dissolving the inhibitor components, then subjecting the slab to hot rolling to obtain a hot rolled steel sheet, and then subjecting the hot rolled steel sheet to hot band annealing as necessary, and subsequent cold rolling once, or twice or more with intermediate annealing performed therebetween until reaching final sheet thickness, then subjecting the steel sheet to primary recrystallization annealing in wet hydrogen atmosphere to perform primary recrystallization and decarburization, and then applying thereon an annealing separator mainly composed of magnesia (MgO) and performing final annealing at 1200° C. for around 5 hours for secondary recrystallization and purification of inhibitor components (e.g. see U.S. Pat. No. 1,965,559A (PTL 1), JPS4015644B (PTL 2) and JPS5113469B (PTL 3)).

However, high temperature heating of a slab not only causes an increase in facility costs to achieve heating, but also increases the amount of scale generated during hot rolling and decreases production yield, and further, it causes problems including complicated maintenance of facilities, and therefore, recent demands for reduction in production costs could not be met.

For this reason, various developments have been made for a technique of causing secondary recrystallization without containing inhibitor components in the slab. For example, a technique capable of stably causing secondary recrystallization without containing inhibitor components in the slab, by increasing S content in the steel matrix after primary recrystallization annealing and before completion of secondary recrystallization (sulfur increasing method) has been proposed (JP4321120B (PTL 4)).

Further, a technique that enables strengthening inhibitors after primary recrystallization annealing and before completion of secondary recrystallization and stably causing secondary recrystallization without containing inhibitor components in the slab, by performing gas nitriding before or after decarburization annealing (JP2771634B (PTL 5)), as well as a technique of disposing a reducing zone in front of a nitriding zone to provide a reducing effect to the oxide layer of the steel sheet surface (JPH03122227A (PTL 6)) have been proposed.

Further, in order to perform uniform nitriding over the whole strip during such gas nitriding process, a method of dividing and adjusting the nitriding gas supplied by a nozzle or a spray at the center part of the steel sheet and both ends of the steel sheet, has been proposed (JP3940205B (PTL 7)).

CITATION LIST

Patent Literature

PTL 1: U.S. Pat. No. 1,965,559A
PTL 2: JPS4015644B
PTL 3: JPS5113469B
PTL 4: JP4321120B
PTL 5: JP2771634B
PTL 6: JPH03122227A
PTL 7: JP3940205B

SUMMARY

However, with the technique disclosed in PTL 4, there were cases where the non-uniformity in the temperature and atmosphere during coil heating caused variation in the increase amount of sulfur in the coil and differences in secondary recrystallization behavior, which lead to variation of magnetic properties.

Further, the techniques disclosed in PTLs 5 to 7 are methods of performing nitriding by spraying nitriding gas on the steel sheet. Therefore, non-uniformity of the furnace temperature in terms of duration and position, and difference in decomposition amount of nitriding gas in pipes caused by heat could cause a difference in nitrogen increase depending on the area of the strip, and as a result, secondary recrystallization could become non-uniform and lead to deterioration of magnetic properties.

It could therefore be helpful to provide a method for nitriding a grain-oriented electrical steel sheet which is very useful in obtaining excellent magnetic properties with no variation without containing inhibitor components in the slab when producing a grain-oriented electrical steel sheet, by performing appropriate nitriding before secondary recrystallization and uniformly dispersing inhibitor forming elements over the full length and full width of the strip, together with a nitriding device suitable for performing the method.

In order to solve the above problems, we have made intensive studies.

As a result, we discovered the following points regarding nitriding of a strip (steel sheet).

(1) When adding nitrogen by reaction from a vapor phase, for example, the temperature during the treatment or the reactivity of the surface has a great influence, and therefore variation cannot be avoided.

(2) By performing nitriding itself by reaction from a liquid phase, in particular, by performing nitriding in molten salt, the influence caused by the above factors which become the cause of variation can be minimized, and therefore excellent magnetic properties can be obtained stably for the whole strip.

This nitriding using molten salt is used in batch treatment for hardening surface layers of automobile components and the like. However, the required amount of nitridation for grain-oriented electrical steel sheets is extremely small compared to that required for hardening the surface layers of such components. Further, the range of the appropriate amount of nitridation is very narrow. For these reasons, the immersion time needs to be controlled with high accuracy.

For precisely controlling immersion time, batch treatment is normally advantageous. However, for grain-oriented electrical steel sheets, it is necessary to continuously perform nitriding for strips adding up to several tons to several tens of tons in total weight. Further, in order to maintain a continuous sheet passage, it would be necessary to change the amount of nitridation or change the sheet passing speed during sheet passage depending on the thickness of the strip or the required amount of nitridation, and therefore measures to deal with these problems would be required.

We discovered the following regarding a method for simply and appropriately responding to the changes in required immersion time or sheet passage speed which are problems that arise when utilizing the above molten salt bath treatment for continuous strip treatment.

(3) A method of adjusting the moving distance of the strip inside the molten salt bath by making the sink roll disposed inside the molten salt bath movable, would be advantageous.

(4) Further, when performing nitriding in molten salt, the amount of nitridation can be controlled by energization, and by using energization, the time required for nitriding can be reduced.

This disclosure has been made based on these discoveries. We thus provide:

1. A method for nitriding a grain-oriented electrical steel sheet comprising immersing a strip in a molten salt bath after cold rolling and before secondary recrystallization annealing during producing a grain-oriented electrical steel sheet, to subject the strip to continuous nitriding.

2. The method for nitriding a grain-oriented electrical steel sheet according to aspect 1, wherein a sink roll that is movable vertically or horizontally is disposed inside the molten salt bath, and by moving the sink roll, the immersion time of the strip inside the molten salt bath is adjustable.

3. The method for nitriding a grain-oriented electrical steel sheet according to aspect 1 or 2, wherein the temperature of the molten salt bath is 400° C. to 700° C. and the immersion time is 5 seconds to 1000 seconds in the step of immersing a strip in a molten salt bath.

4. A method for nitriding a grain-oriented electrical steel sheet comprising applying voltage between a strip and a counter electrode to perform electrolytic treatment while immersing the strip in a molten salt bath of electrolyte after cold rolling and before secondary recrystallization annealing during producing a grain-oriented electrical steel sheet, to subject the strip to continuous nitriding.

5. The method for nitriding a grain-oriented electrical steel sheet according to aspect 4, further comprising changing the current density during the electrolytic treatment to adjust the amount of nitridation of the strip.

6. The method for nitriding a grain-oriented electrical steel sheet according to aspect 4 or 5, wherein the temperature of the molten salt bath is 300° C. to 700° C. and the immersion time is 3 seconds to 300 seconds in the step of immersing a strip in a molten salt bath.

7. A device for nitriding a grain-oriented electrical steel sheet by performing the method according to any one of aspects 1 to 3, the device comprising:

a vessel for holding a molten salt bath;

a heating and temperature adjusting device for heating the molten salt bath to a predetermined temperature and maintaining the molten salt bath at the predetermined temperature; and a sink roll for supporting the strip passing inside the molten salt bath.

8. The device according to aspect 7, wherein the sink roll disposed inside the molten salt bath is movable vertically or horizontally so that the immersion distance of the strip inside the molten salt bath is changeable.

9. The device according to aspect 7 or 8, wherein multiple sink rolls which are movable vertically or horizontally are disposed inside the molten salt bath so that the immersion distance of the strip inside the molten salt bath is changeable by moving the sink rolls.

10. The device according to any one of aspects 7 to 9, wherein multiple sink rolls which are movable vertically or horizontally are disposed inside the molten salt bath and multiple deflector rolls which are movable vertically or horizontally are disposed outside the molten salt bath, and by placing the strip to wrap about these sink rolls and deflector rolls so that the immersion distance of the strip inside the molten salt bath is changeable.

11. A device for performing the method for nitriding a grain-oriented electrical steel sheet according to any one of aspects 4 to 6, comprising:

a vessel for holding the molten salt bath;

a heating and temperature adjusting device for heating a molten salt bath to a predetermined temperature and maintaining the molten salt bath at the predetermined temperature;

a sink roll for supporting a strip passing inside the molten salt bath; and an electrode for applying voltage to the strip passing inside the molten salt bath.

12. The device according to aspect 11, wherein the sink roll is an electrode roll which also serves as an electrode for applying voltage to the strip and a counter electrode is provided opposite thereto inside the molten salt bath.

13. The device according to aspect 11, wherein counter electrodes for applying voltage to the strip are provided on both sides of the strip passing inside the molten salt bath.

14. The device according to aspect 13, wherein electricity is supplied to the strip via electrode rolls disposed outside the molten salt bath.

With this disclosure, it is possible to suppress variation of nitriding and to stably guarantee a uniform amount of nitridation throughout the whole strip, and therefore it is possible to stably obtain excellent magnetic properties over the full length and full width of the strip. Further the disclosure enables simply and appropriately responding to the changes in required immersion time or sheet passage speed. For these reasons, the disclosure has a significant industrial usefulness.

Further, particularly when controlling the amount of nitridation by energization, it is possible to reduce the nitridation time which directly affects the production efficiency.

DETAILED DESCRIPTION

Our methods and components will be described in detail below.

In this disclosure, an embodiment where nitriding is carried out by simply immersing the strip in the molten salt bath will be referred to as the first embodiment, and an embodiment where nitriding is carried out by performing electrolytic treatment while immersing the strip in the molten salt bath will be referred to as the second embodiment. Each embodiment will be described separately below.

First Embodiment

Figure 1:
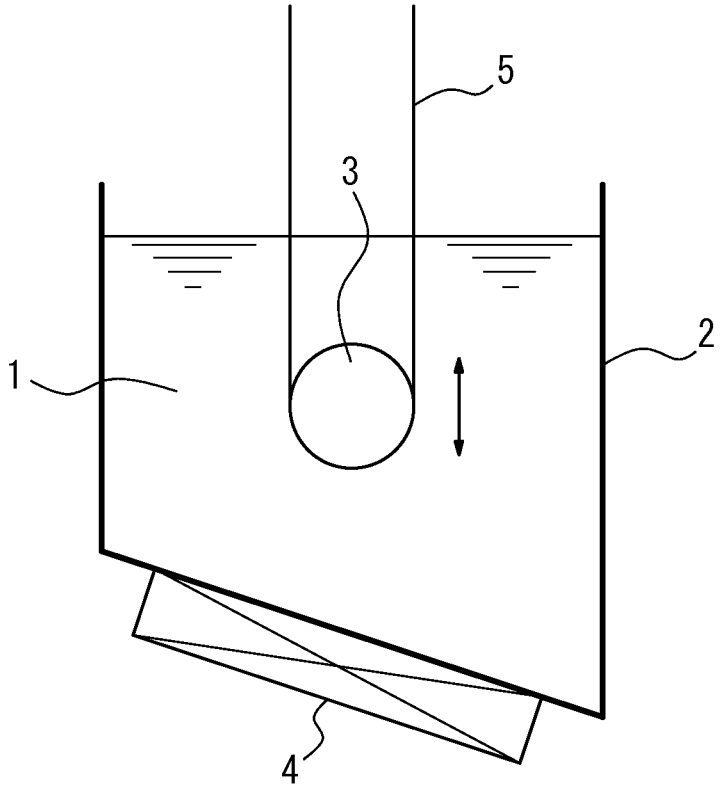
FIG. 1 shows an example of a nitriding device (with one sink roll) suitable for using in the first embodiment.

FIG. 1 shows an example of a nitriding device suitable for using in the first embodiment. In the figure, a molten salt bath is labeled 1, a vessel containing the molten salt bath 1 is labeled 2, a sink roll is labeled 3, a heating and temperature adjusting device is labeled 4, and a strip (steel sheet) is labeled 5.

In this disclosure, as the molten salt bath (molten salt bath of electrolyte), a salt bath mainly composed of cyanate, for example, a mixed salt bath of alkali cyanate, alkali cyanide, and alkali carbonate, or a mixed salt bath of alkali cyanate, alkali cyanurate and alkali carbonate may advantageously be used. However, the molten salt bath is not limited to the above, and any means of salt bath (salt bath of electrolyte) that can perform nitriding to the strip can be used.

Further, the molten salt bath 1 inside the vessel 2 can be heated and maintained at a desired temperature by a heating and temperature adjusting device 4. FIG. 1 shows an example where the heating and temperature adjusting device is disposed on the outside of the bottom part of the vessel 2. However, the disposing position is not limited to this position, and a required number of said devices can be disposed inside or outside the vessel 2 in an appropriate position.

By immersing the strip 5 inside the molten salt bath 1 via the sink roll 3, the surface of the strip 5 is subjected to nitriding under a stable sheet passage.

Preferably, the temperature of the molten salt bath is around 400° C. to 700° C., and the immersion time is around 5 s to 1000 s.

Further, the amount of nitridation caused by the above nitriding is preferably 50 ppm or more and 3000 ppm or less. This is because if the amount of nitridation is less than 50 ppm, a sufficient effect cannot be obtained, whereas if it exceeds 3000 ppm, an excessive amount of silicon nitride or the like precipitates and secondary recrystallization hardly occurs. A preferable amount of nitridation is in the range of 150 ppm or more and 1000 ppm or less.

Further, in this embodiment, by making the sink roll 3 immersed and disposed inside the molten salt bath 1 movable at least vertically or horizontally (vertically in FIG. 1), it is possible to adjust the immersion distance, as well as the immersion time of the strip 5 inside the molten salt bath.

Therefore, when it is necessary to change the sheet passing speed during the sheet passage, the immersion time can be maintained by moving the sink roll vertically or horizontally as appropriate and adjusting the immersion distance of the strip, and further a situation where it is necessary to change the immersion time for each strip can also be easily dealt with.

The movement of the sink roll is not limited to the vertical direction or the horizontal direction, and the sink roll can be moved in other directions such as the diagnol direction.

Figure 2:
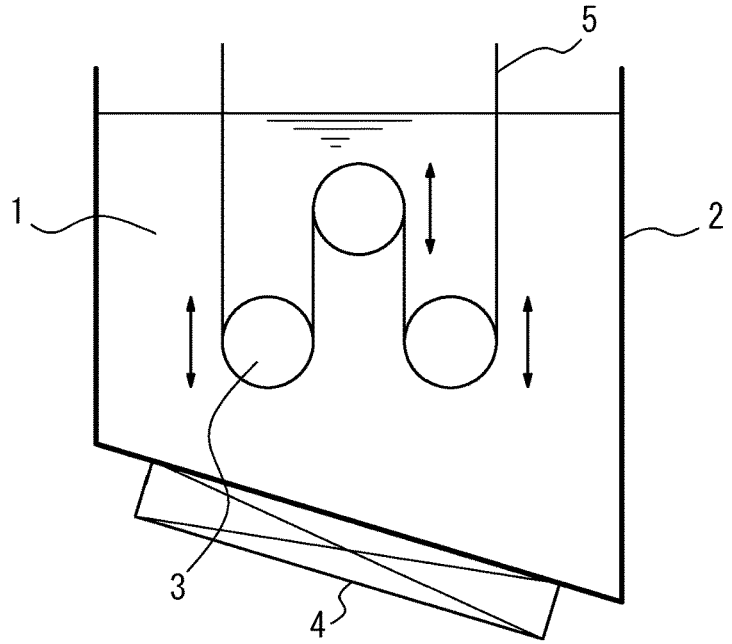
FIG. 2 shows a different example of a nitriding device (with three sink rolls) suitable for using in the first embodiment.
Figure 3:
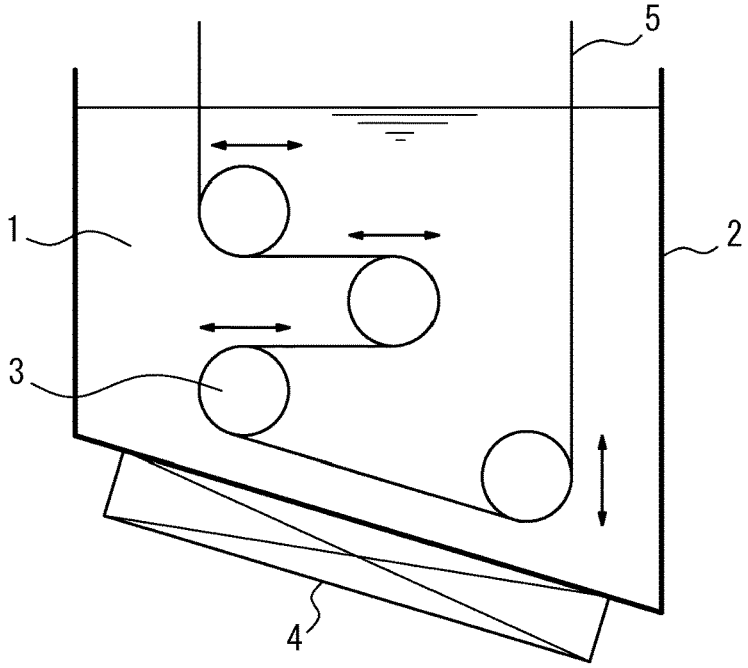
FIG. 3 shows a different example of a nitriding device (with four sink rolls) suitable for using in the first embodiment.

FIG. 1 shows one sink roll 3 disposed inside a molten salt bath 1. However, as shown in FIG. 2 and FIG. 3, multiple sink rolls 3 can be disposed inside the molten salt bath, and by appropriately moving these sink rolls 3 inside the bath, it is possible to expand the range of maintaining the immersion time even when it is necessary to change the sheet passing speed, and a proper response can be taken without enlarging the immersion bath and therefore the running cost can be reduced.

Figure 4:
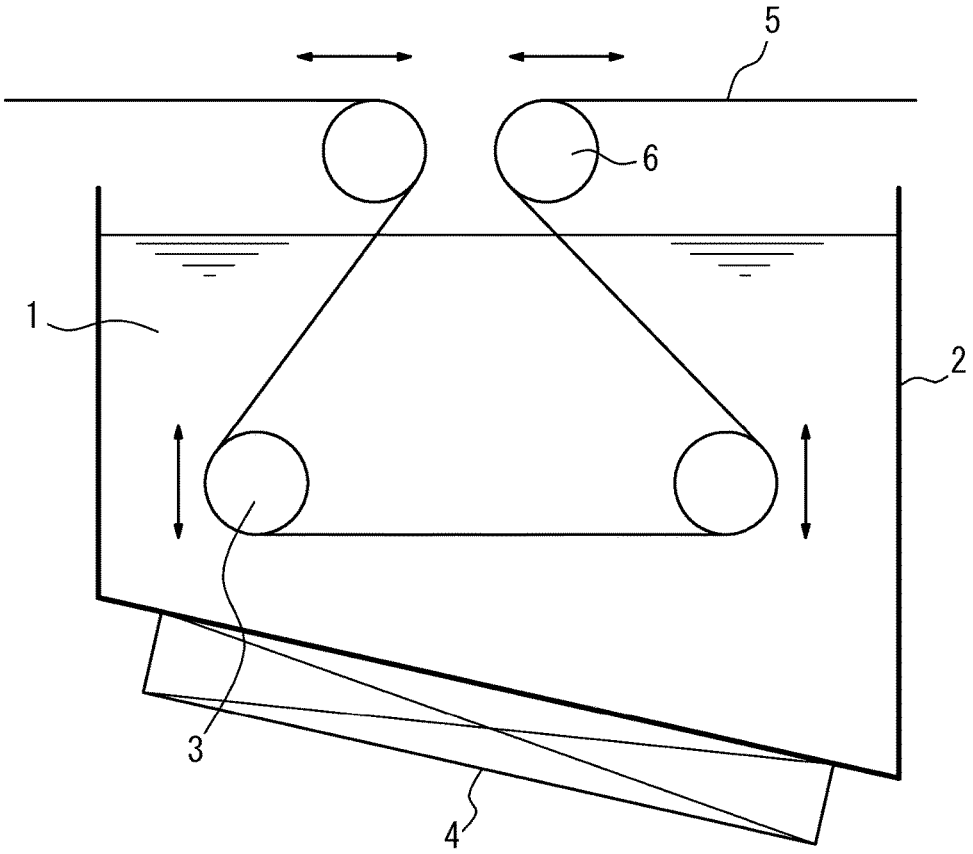
FIG. 4 shows a different example of a nitriding device (with two sink rolls and two deflector rolls) suitable for using in the first embodiment.

Further, FIG. 4 shows sink rolls 3 disposed inside the molten salt bath and deflector rolls 6 disposed outside the molten salt bath, and by placing the strip 5 so that it wraps about the sink rolls 3 inside the molten salt bath and the adjacent deflector rolls 6 outside the molten salt bath, the immersion time can be adjusted.

In actual facilities, these means may be selected and applied as appropriate depending on the required immersion time and amount of adjustment.

Second Embodiment

Figure 5:
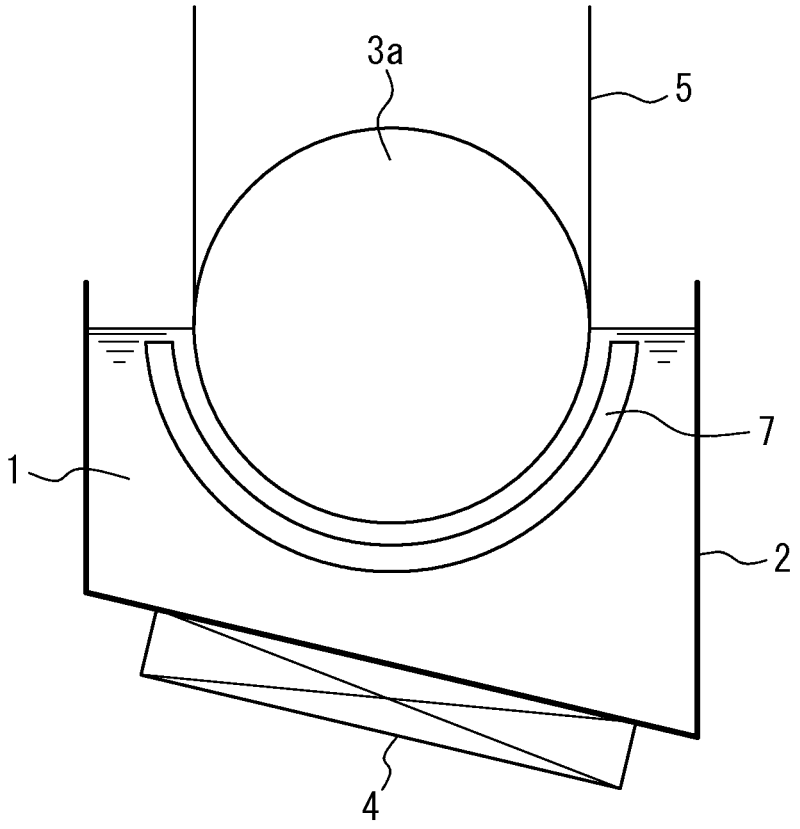
FIG. 5 shows an example of a nitriding device (where the sink roll is a half-immersed roll) suitable for using in the second embodiment.

FIG. 5 shows an example of a nitriding device suitable for use in the second embodiment. In the figure, a molten salt bath is labeled 1, a vessel containing the molten salt bath 1 is labeled 2, a sink roll is labeled 3, a heating and temperature adjusting device is labeled 4, a strip (steel sheet) is labeled 5, and a counter electrode is labeled as 7.

In this example, the sink roll 3, as shown in the figure, is a half-immersed roll 3*a* where the lower half of the roll is immersed inside the molten salt bath 1. This half-immersed roll 3*a* is allowed to function as an electrode roll which also serves as an electrode that applies voltage to the strip.

The preferable molten salt bath for this embodiment is the same as that for the first embodiment.

Further, as in the case for the first embodiment, the molten salt bath 1 inside the vessel 2 is heated to and maintained at a desired temperature by the heating and temperature adjusting device 4.

Further, by immersing the strip 5 inside the molten salt bath 1 via the half-immersed roll 3*a*, and applying voltage between the half-immersed roll 3*a* (electrode roll) and the counter electrode provided opposite to the half-immersed roll 3*a* during the immersion to perform electrolytic treatment, the surface of the strip 5 is subjected to nitriding under a stable sheet passage and within a short period of time.

Further, with the nitriding device shown in FIG. 5, nitriding is performed on only one side of the strip. Therefore, in order to perform nitriding on both sides of the strip, another nitriding device will be required.

The temperature of the molten salt bath is preferably around 300° C. to 700° C. A particularly preferable range is 400° C. to 600° C. Further, the immersion time is preferably around 3 s to 300 s. A particularly preferable range is 3 s to 100 s. When performing nitriding, electrolytic treatment is performed in addition to immersion treatment in this disclosure, and it is possible to reduce the nitriding time to approximately ½ of when such electrolytic treatment is not performed.

Further, as in the case for the first embodiment, the amount of nitridation caused by the above nitriding is preferably 50 ppm or more and 3000 ppm or less.

Further, in this embodiment, when it is necessary to change the sheet passing speed during the sheet passage, or when it is necessary to change the amount of nitridation for each strip, it is possible to simply and promptly respond by changing the applied voltage i.e. the current density.

In order to obtain the above required amount of nitridation, the current density during energization is preferably around 1 A/dm$^2$ to 20 A/dm$^2$, and the current density can be adjusted as appropriate in this range by taking into consideration of electrode life, nitridation efficiency or the like.

Figure 6:
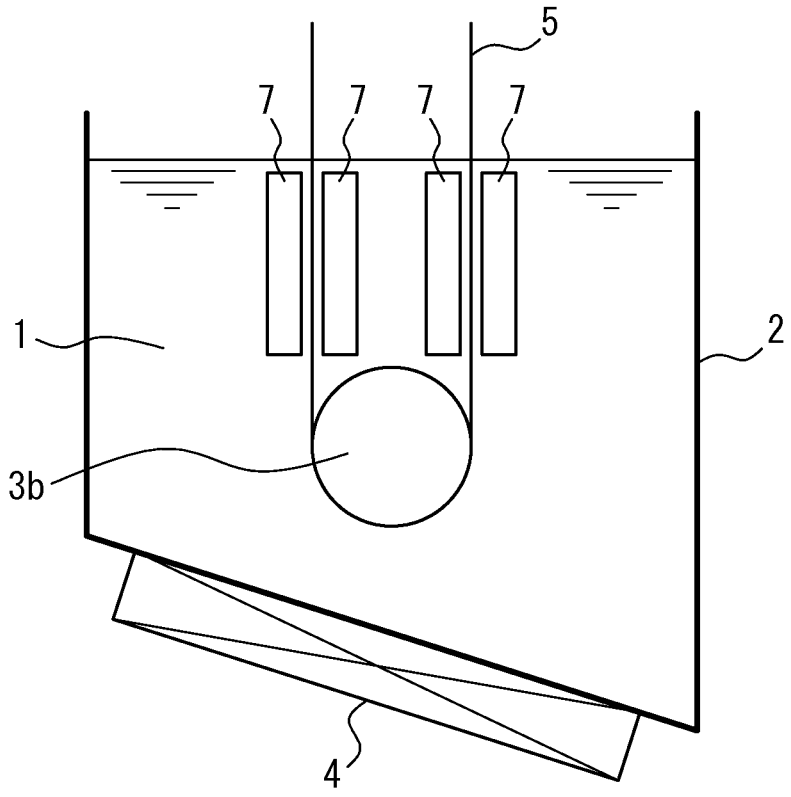
FIG. 6 shows a different example of a nitriding device (where the sink roll is a full-immersed roll) suitable for using in the second embodiment.

In FIG. 5, a half-immersed roll is used as the sink roll 3, whereas in FIG. 6, a full-immersed roll is used as the sink roll 3. In FIG. 6, the strip 5 introduced into and taken out from the molten salt bath via the full-immersed roll 3*b* is subjected to nitriding by electrolytic treatment on both sides of the strip 5, by setting counter electrodes 7 on both sides thereof for applying voltage. Further, the full-immersed roll 3*b* serves as the electrode roll in FIG. 6, as the half-immersed roll 3*a* serves as the electrode roll in FIG. 5.

In the case for FIG. 6, counter electrodes 7 are disposed on both sides of the strip 5 to uniformly treat both sides of the strip at once, and therefore it enables nitriding in a shorter period of time.

Figure 7:
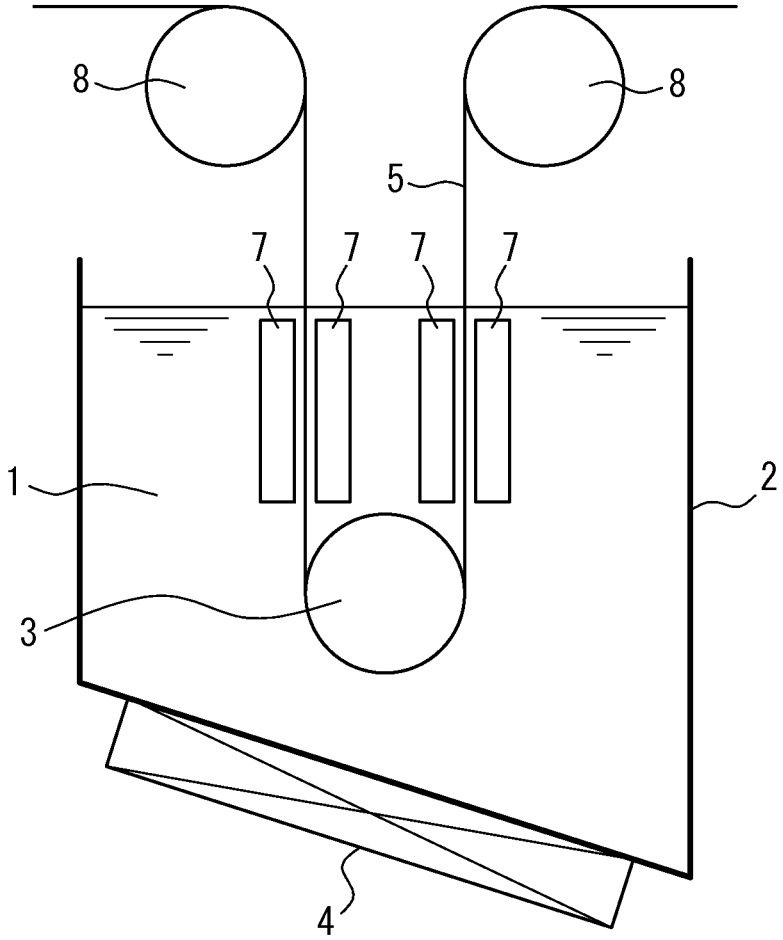
FIG. 7 shows a different example of a nitriding device (where electrode rolls are disposed outside the molten salt bath) suitable for using in the second embodiment.

In FIG. 7, electricity is supplied to the strip 5 from electrode rolls 8 disposed outside the molten salt bath. With this method of energization, it is not required to consider stabling the energization state between the electrode roll 8 and the strip 5 in the molten salt bath 1, and therefore management is easier compared to when using an immersed electrode roll, and costs can be reduced.

While above have been mainly explained cases of performing nitriding on a strip, the treatment method and treatment device disclosed herein can be applied for performing not only nitriding but carbonitriding or sulphonitriding as well.

Further, the device disclosed herein may be an independent facility that continuously performs nitriding and the like, or be attached to a processing line for performing another treatment, and in case of a continuous line, it may be attached to the optimal place considering conditions including efficiency.

In the disclosure, the strip which is the material to be treated is not particularly limited and, as long as it is a grain-oriented electrical steel strip, any conventionally known strip is applicable.

In this disclosure, during the production process of the grain-oriented electrical steel strip, processes other than the nitriding process using the molten salt bath are not particularly limited, and any conventionally known production process can be applied.

EXAMPLES

Example 1 (First Embodiment)

A continuous casting slab for a grain-oriented electrical steel sheet containing Si of 3.3 mass % was subjected to heating, and then to hot rolling to obtain a hot rolled sheet with sheet thickness of 2.5 mm, and then the hot rolled sheet was subjected to hot band annealing, followed by cold rolling to obtain a final sheet thickness of 0.22 mm, and then the cold rolled sheet was subjected to primary recrystallization annealing to obtain a strip which in turn was subjected to nitriding using a molten salt bath under the conditions shown in Table 1.

The amount of nitridation was measured for each of the front and back sides of the strip obtained after nitriding, and the difference in the amount of nitridation between each side was investigated. Measurement of the amount of nitridation was performed by cutting out samples for said measurement of 50 mm×30 mm, polishing and grinding the surface opposite to the measuring surface until reaching the center part in sheet thickness direction, and then performing chemical analysis.

The obtained results are shown in Table 1.

TABLE 1

| | Nitriding Conditions | | | Amount of Nitridation (ppm) | | | Difference in |
|---|---|---|---|---|---|---|---|
| No. | Types of Salt Bath | Bath Temp. (° C.) | Immersion Time (s) | Front Side X | Back Side Y | Difference between Front and Back Sides \|X − Y\| | Amount of Nitridation between Front and Back Sides (%) |
| 1 | Alkali Cyanate + Alkali Cyanide + Alkali Carbonate | 480 | 180 | 162 | 155 | 7 | 4.4 |
| 2 | Alkali Cyanate + Alkali Cyanide + Alkali Carbonate | 480 | 600 | 919 | 946 | 27 | 2.9 |
| 3 | Alkali Cyanate + Alkali Cyanide + Alkali Carbonate | 520 | 180 | 268 | 261 | 7 | 2.6 |
| 4 | Alkali Cyanate + Alkali Cyanide + Alkali Carbonate | 520 | 300 | 382 | 368 | 14 | 3.7 |
| 5 | Alkali Cyanate + Alkali Cyanide + Alkali Carbonate | 560 | 30 | 86 | 83 | 3 | 3.6 |
| 6 | Alkali Cyanate + Alkali Cyanide + Alkali Carbonate | 560 | 180 | 449 | 478 | 29 | 6.3 |
| 7 | Alkali Cyanate + Alkali Cyanurate + Alkali Carbonate | 560 | 60 | 129 | 122 | 7 | 5.6 |

TABLE 1-continued

| No. | Types of Salt Bath | Nitriding Conditions: Bath Temp. (° C.) | Nitriding Conditions: Immersion Time (s) | Amount of Nitridation (ppm): Front Side X | Amount of Nitridation (ppm): Back Side Y | Difference between Front and Back Sides \|X − Y\| | Difference in Amount of Nitridation between Front and Back Sides (%) |
|---|---|---|---|---|---|---|---|
| 8 | Alkali Cyanate + Alkali Cyanurate + Alkali Carbonate | 560 | 300 | 410 | 418 | 8 | 1.9 |
| 9 | Alkali Cyanate + Alkali Cyanurate + Alkali Carbonate | 620 | 60 | 442 | 421 | 21 | 4.9 |
| 10 | Alkali Cyanate + Alkali Cyanurate + Alkali Carbonate | 620 | 600 | 1160 | 1135 | 25 | 2.2 |
| 11 | Alkali Cyanate + Alkali Cyanurate + Alkali Carbonate | 620 | 1200 | 2545 | 2505 | 40 | 1.6 |

As shown in Table 1, when performing nitriding using a molten salt bath as described in this disclosure, the difference in the amount of nitridation between the front and back sides was less than 7% which is extremely small, and it can be understood that a strip with small variation in the amount of nitridation can be obtained stably.

Example 2 (Second Embodiment)

A continuous casting slab for a grain-oriented electrical steel sheet containing Si of 3.3 mass % was subjected to heating, and then to hot rolling to obtain a hot rolled sheet with sheet thickness of 2.5 mm, and then the hot rolled sheet was subjected to hot band annealing, followed by cold rolling to obtain a final sheet thickness of 0.22 mm, and then the cold rolled sheet was subjected to primary recrystallization annealing to obtain a strip which in turn was subjected to nitriding by electrolytic treatment using a molten salt bath under the conditions shown in Table 2.

The amount of nitridation was measured for each of the front and back sides of the strip obtained after nitriding, and the difference in the amount of nitridation between each side was investigated. Measurement of the amount of nitridation was performed by cutting out samples for said measurement of 50 mm×30 mm, polishing and grinding the surface opposite to the measuring surface until reaching the center part in thickness direction, and then performing chemical analysis.

The obtained results are shown in Table 2.

TABLE 2

| No. | Types of Salt Bath | Nitriding Conditions: Bath Temp. (° C.) | Nitriding Conditions: Immersion Time (s) | Nitriding Conditions: Current Density (A/dm$^2$) | Amount of Nitridation (ppm): Front Side X | Amount of Nitridation (ppm): Back Side Y | Difference between Front and Back Sides \|X − Y\| | Difference in Amount of Nitridation between Front and Back Sides (%) |
|---|---|---|---|---|---|---|---|---|
| 1 | Alkali Cyanate + Alkali Cyanide + Alkali Carbonate | 520 | 10 | 5 | 198 | 193 | 5 | 2.6 |
| 2 | Alkali Cyanate + Alkali Cyanide + Alkali Carbonate | 520 | 10 | 6 | 222 | 228 | 6 | 2.7 |
| 3 | Alkali Cyanate + Alkali Cyanide + Alkali Carbonate | 560 | 5 | 5 | 126 | 121 | 5 | 4 |
| 4 | Alkali Cyanate + Alkali Cyanide + Alkali Carbonate | 560 | 10 | 4.5 | 224 | 219 | 5 | 2.3 |
| 5 | Alkali Cyanate + Alkali Cyanurate + Alkali Carbonate | 560 | 10 | 5 | 153 | 156 | 3 | 1.9 |
| 6 | Alkali Cyanate + Alkali Cyanurate + Alkali Carbonate | 560 | 30 | 5 | 438 | 412 | 26 | 6.1 |

* For every case, the steel sheet serves as the anode when applying voltage.

As shown in Table 1, when performing nitriding using a molten salt bath as described in this disclosure, the difference in the amount of nitridation between the front and back sides was less than 7% which is extremely small, and it can be understood that a strip with small variation in the amount of nitridation can be obtained stably.

REFERENCE SIGNS LIST

1 Molten Salt Bath
2 Vessel
3 Sink Roll
4 Heating and Temperature Adjusting Device
5 Strip (Steel Sheet)
6 Deflector Roll
7 Counter Electrode
8 Electrode Roll

The invention claimed is:

1. A method for nitriding a grain-oriented electrical steel sheet comprising applying voltage between a strip and a counter electrode to perform electrolytic treatment while immersing the strip in a molten salt bath of electrolyte after cold rolling and before secondary recrystallization annealing during producing a grain-oriented electrical steel sheet, to subject the strip to continuous nitriding.

2. The method for nitriding a grain-oriented electrical steel sheet according to claim 1, further comprising changing the current density during the electrolytic treatment to adjust the amount of nitridation of the strip.

3. The method for nitriding a grain-oriented electrical steel sheet according to claim 2, wherein the temperature of the molten salt bath is 300° C. to 700° C. and the immersion time is 3 seconds to 300 seconds in the step of immersing a strip in a molten salt bath.

4. The method for nitriding a grain-oriented electrical steel sheet according to claim 1, wherein the temperature of the molten salt bath is 300° C. to 700° C. and the immersion time is 3 seconds to 300 seconds in the step of immersing a strip in a molten salt bath.

5. A device for performing the method for nitriding a grain-oriented electrical steel sheet according to claim 1, comprising:

a vessel for holding the molten salt bath;

a heating and temperature adjusting device for heating a molten salt bath to a predetermined temperature and maintaining the molten salt bath at the predetermined temperature;

a sink roll for supporting a strip passing inside the molten salt bath; and an electrode for applying voltage to the strip passing inside the molten salt bath, wherein the sink roll is an electrode roll which also serves as an electrode for applying voltage to the strip and a counter electrode is provided opposite thereto inside the molten salt bath.

6. A device for performing the method for nitriding a grain-oriented electrical steel sheet according to claim 1, comprising:

a vessel for holding the molten salt bath;

a heating and temperature adjusting device for heating a molten salt bath to a predetermined temperature and maintaining the molten salt bath at the predetermined temperature;

a sink roll for supporting a strip passing inside the molten salt bath; and an electrode for applying voltage to the strip passing inside the molten salt bath, wherein counter electrodes for applying voltage to the strip are provided on both sides of the strip passing inside the molten salt bath.

7. The device according to claim 6, wherein electricity is supplied to the strip via electrode rolls disposed outside the molten salt bath.

* * * * *